US008614659B2

(12) United States Patent
Miyazawa

(10) Patent No.: US 8,614,659 B2
(45) Date of Patent: Dec. 24, 2013

(54) DISPLAY DEVICE

(75) Inventor: Toshio Miyazawa, Chiba (JP)

(73) Assignees: Hitachi Displays, Ltd., Chiba (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 1073 days.

(21) Appl. No.: 11/644,831

(22) Filed: Dec. 26, 2006

(65) Prior Publication Data

US 2007/0146274 A1 Jun. 28, 2007

(30) Foreign Application Priority Data

Dec. 26, 2005 (JP) ..... 2005-371302

(51) Int. Cl.
*G09G 3/36* (2006.01)

(52) U.S. Cl.
USPC ..... 345/89

(58) Field of Classification Search
USPC ..... 345/87–104
See application file for complete search history.

(56) References Cited

U.S. PATENT DOCUMENTS

| | | | | |
|---|---|---|---|---|
| 6,771,241 | B2 | 8/2004 | Miyazawa et al. | |
| 6,873,320 | B2 * | 3/2005 | Nakamura | 345/204 |
| 2002/0167477 | A1 * | 11/2002 | Tsutsui et al. | 345/89 |
| 2003/0098860 | A1 * | 5/2003 | Nakamura et al. | 345/211 |
| 2005/0253797 | A1 * | 11/2005 | Kamada et al. | 345/89 |

FOREIGN PATENT DOCUMENTS

| | | |
|---|---|---|
| JP | 2000-338918 | 12/2000 |
| JP | 2003-308048 | 10/2003 |
| JP | 2004-045623 | 2/2004 |

* cited by examiner

*Primary Examiner* — Kenneth Bukowski
(74) *Attorney, Agent, or Firm* — Antonelli, Terry, Stout & Kraus, LLP.

(57) ABSTRACT

A display device for use in compact portable devices is configured for assigning gray levels according to the pixel area ratio and, further includes a digital-to-analog (D-A) conversion circuit for converting digital data to gray-level voltage or analog signals. This configuration reduces the size of the circuit for D-A conversion, thus reducing the space for the driving circuit when assigning gray levels according to the pixel area ratio. The combination of the gray-level voltage output from the driving circuit and the gray-level assignment according to the pixel area ratio reduces the scale of the circuit.

13 Claims, 16 Drawing Sheets

DISPLAY DEVICE

BACKGROUND OF THE INVENTION

1. Field of the Invention

The present invention relates to an active matrix display device, and more particularly, to a display device including a circuit for converting a digital signal to an analog signal.

2. Description of the Related Art

Thin-film-transistor (TFT) liquid crystal display devices including switching devices in pixel sections are widely used as display devices for personal computers. The TFT display devices are also used in portable remote terminals such as mobile phones. More compact and power-saving display devices than conventional liquid crystal devices are required for use in portable remote terminals. Furthermore a demand for compact and higher-definition display devices is increasing.

Problems associated with the miniaturization include a decrease in space for mounting the driving circuits of the display devices. Problems associated with higher-definition include an increase in the scale of the driving circuit due to an increase in the number of pixels.

It is preferable that display devices have a narrower periphery (narrower frame) than the display area. However, the periphery of the display area is used for mounting the driving circuits. Thus, the driving circuits need to be more compact, so that the mounting area is limited to narrow the frame. Furthermore, although the number of pixels increases as higher-definition display devices are being developed, an increase in the mounting area is limited. In achieving higher-definition devices, the pitch of connecting terminals is decreased as the number of outputs from the driving circuits increases, producing the problems of reducing reliability and increasing manufacturing cost as the scale of the circuit increases.

Accordingly, in order to achieve smaller driving circuits and to solve the problems due to the connection and the increase in manufacturing cost, a driving-circuit built-in display device has been developed toward practical use in which driving circuits are manufactured on the same substrate as that of the switching elements of the pixel section by the same manufacturing process.

However, of the driving circuits, a D-A conversion circuit for converting a digital signal to an analog signal to output gray-level voltage has a complicated structure; the scale of the circuit increases as the number of the bits of the display data increases to 4, 6, and 8 when increasing the gray levels to be assigned. As a result, the driving-circuit built-in display device faces the problem of an increase in the area for the driving circuits.

Accordingly, there is proposed a display device in which the gray level is changed according to the area ratio of pixels to increase the gray levels while maintaining the compact circuit scale. An example of the display device in which the gray level depends on the pixel area ratio is disclosed in U.S. Pat. No. 6,771,241. However, the display device disclosed in U.S. Pat. No. 6,771,241 does not take the operation of the driving circuits into consideration.

In addition to the need for increasing the gray levels, high transmission opening ratio is required for display devices. Furthermore, more stable, reliable, and compact driving circuits are required.

SUMMARY OF THE INVENTION

The invention is made to solve the above problems of the related art. Accordingly, it is an object of the invention to provide a technique for achieving driving circuits best suited to compact display devices capable of providing multiple gray levels.

The above and other objects and novel features of the invention will be appear from the following detailed description and accompanying drawings.

A typical embodiment of the invention will be briefly described hereinbelow.

The display device according to an aspect of the invention includes pixel sections each having pixel electrodes and switching elements for supplying a video signal to the pixel electrodes, a video-signal driving circuit for supplying a video signal to the switching elements, and a scanning-signal driving circuit for outputting a scanning signal, which are provided on the same substrate. One pixel section has a plurality of the pixel electrodes with different areas for assigning gray levels.

Gray levels are assigned according to the area ratio of the pixel electrodes, and a gray-level voltage according to the gray level to be displayed is supplied from the video-signal driving circuit to the pixel electrodes. The scanning-signal driving circuit supplies the gray-level voltage to the pixel electrodes by turning on the switching elements in accordance with the timing at which the gray-level voltage is output from the video-signal driving circuit.

This arrangement can reduce the scale of the circuit for D-A conversion and save the space for the driving circuit layout for gray-level assignment according to the area ratio. The combination of the gray-level voltage output from the driving circuit and the gray-level assignment according to the pixel area ratio reduces the scale of the circuit.

The display device according to an aspect of the invention comprises a plurality of pixel sections in a matrix form, the pixel sections each having a plurality of pixel electrodes with different areas; switching elements for supplying a video signal to the pixel electrodes; video signal line for supplying a video signal to the switching elements; a scanning signal line for supplying a scanning signal for controlling the switching elements; a video-signal driving circuit for outputting a gray-level voltage to the video signal line; and a scanning-signal-line driving circuit for outputting a scanning signal to the scanning signal line, which are formed on the same substrate.

The video-signal driving circuit divides one scanning period (hereinafter, also referred to as 1H) into a plurality of output periods (referred to as divided periods) for the pixel electrodes with different areas on one pixel section, and supplies gray-level voltage to each pixel electrode.

The video-signal driving circuit includes a gray-level-voltage selecting circuit and a display-data holding circuit. The display-data holding circuit outputs display data for each pixel electrode in sequence every divided period. The gray-level-voltage selecting circuit outputs gray-level voltage to the video signal line according to the display data.

The scanning-signal-line driving circuit turns on the switching element provided for each pixel electrode in accordance with the start of each divided period to supply gray-level voltage to each pixel electrode.

The display-data holding circuit can output display data for n levels of gray in each divided periods. The area of the pixel electrodes have the relationship of n multiple with one another.

DESCRIPTION OF THE PREFERRED EMBODIMENT

Figure 1:
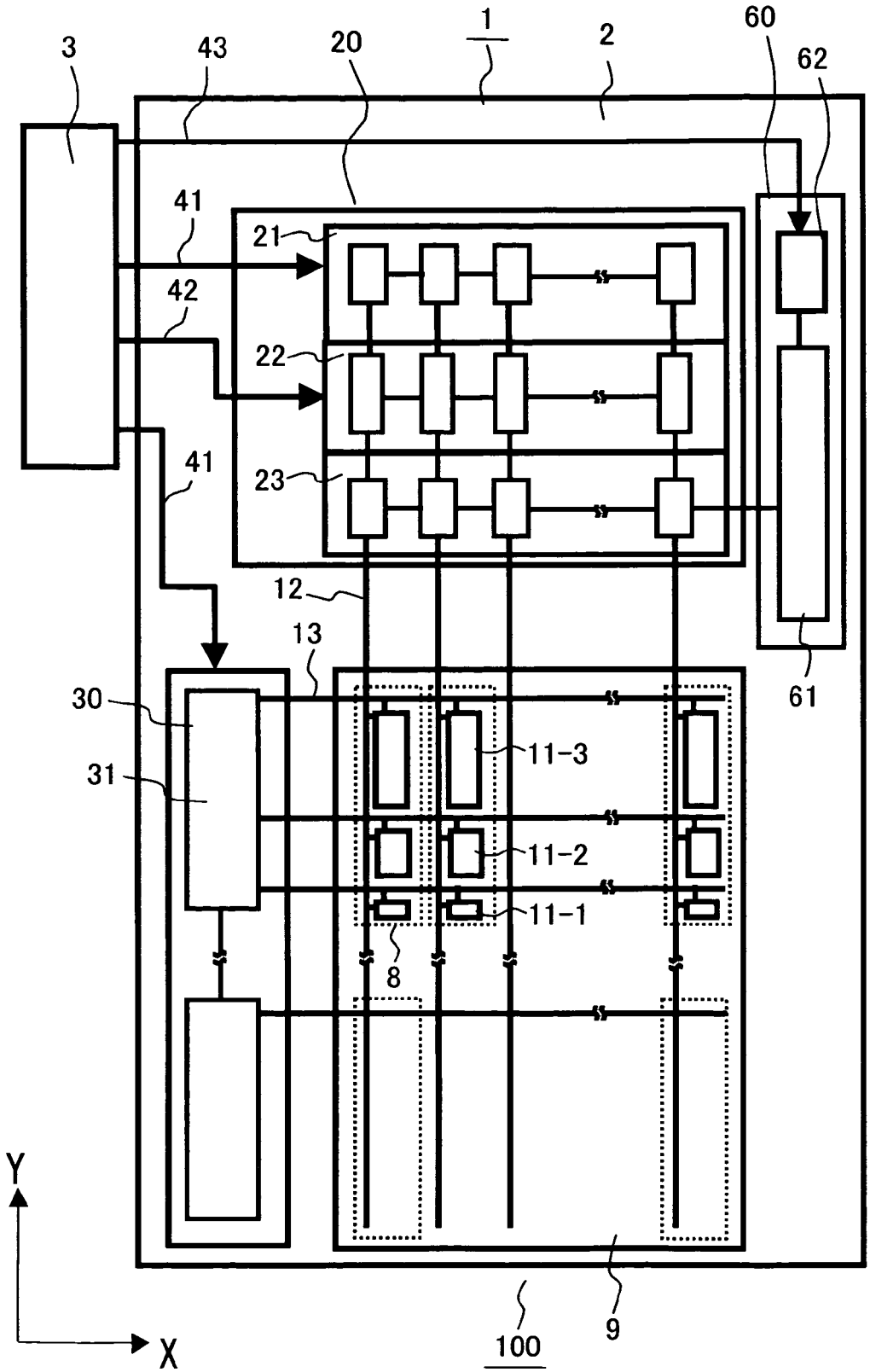
FIG. 1 is a schematic block diagram of a display device according to an embodiment of the invention.

An embodiment of the invention will be described hereinbelow with reference to the drawings, wherein like and corresponding parts in each of the several drawings are identified by the same reference character, and descriptions thereof will be omitted.

FIG. 1 is a block diagram showing the basic configuration of a display device, indicated by numeral 100, according to an embodiment of the invention. As shown in the diagram, the display device 100 comprises a display panel 1 and a control circuit 3.

The display panel 1 includes an insulating device substrate 2 made of transparent glass or plastic. The device substrate 2 has a display region 9. The display region 9 has a pixel section 8 in a matrix form. There area video-signal-line driving circuit 20, a scanning-signal-line driving circuit 30, and a power circuit 60 on the periphery of the display region 9.

The pixel section 8 has a plurality of pixel electrodes 11-1, 11-2, and 11-3. The pixel electrodes 11-1, 11-2, and 11-3 of the pixel section 8 configure the pixels for an image displayed by the display device 100. The pixel electrodes 11-1, 11-2, and 11-3 of this embodiment are in one pixel section and different in area, so that the display device 100 can provide gray levels using the difference in the area ratio of the pixel electrodes 11-1, 11-2, and 11-3.

A plurality of video signal lines 12 extends from the video-signal-line driving circuit 20 to the display region 9 into electrical connection with the pixel section 8. Video signals are supplied to the pixel section 8 through the video signal lines 12. A plurality of scanning signal lines 13 extends from the scanning-signal-line driving circuit 30 to the display region 9 into electrical connection with the pixel section 8 in such a manner as to intersect the video signal lines 12. Scanning signals are supplied to the pixel section 8 through the scanning signal lines 13. The display device 100 write video signals to the pixel electrodes 11-1, 11-2, and 11-3 through the video signal lines 12 by controlling switching elements 10 (see FIG. 2) in the pixel section 8 using the scanning signals.

The power circuit 60 is disposed on the periphery of the display region 9, which generates supply voltage necessary for the display panel 1. The power circuit 60 includes a booster circuit 62 for boosting the voltage supplied through a supply voltage line 43 to generate necessary voltage and a gray-level voltage generating circuit 61 for generating gray-level voltage for use in assigning gray levels. While the circuits of the display device 100 are given necessary supply voltage, the wires for supplying the supply voltage to the circuits are not shown in the drawing for the convenience of description.

The video-signal-line driving circuit 20 is connected to a control signal line 41 and a display data line 42 extending from the control circuit 3. The video-signal-line driving circuit 20 includes a horizontal shift register 21, a display-data holding circuit 22, and a gray-level-voltage selecting circuit 23.

The horizontal shift register 21 outputs a timing signal indicative of the timing for the display-data holding circuit 22 to hold display data in response to a clock signal, one of control signals. The display-data holding circuit 22 holds the display data input through the display data line 42 according to the timing signal. The gray-level-voltage selecting circuit 23 selects a gray-level voltage supplied from the gray-level voltage generating circuit 61 according to the display data held in the display-data holding circuit 22 and outputs it to every video signal line 12.

The scanning-signal-line driving circuit 30 includes a vertical shift register 31, which outputs scanning signals to the scanning signal lines 13 in sequence during one scanning period (1H).

Figure 2:
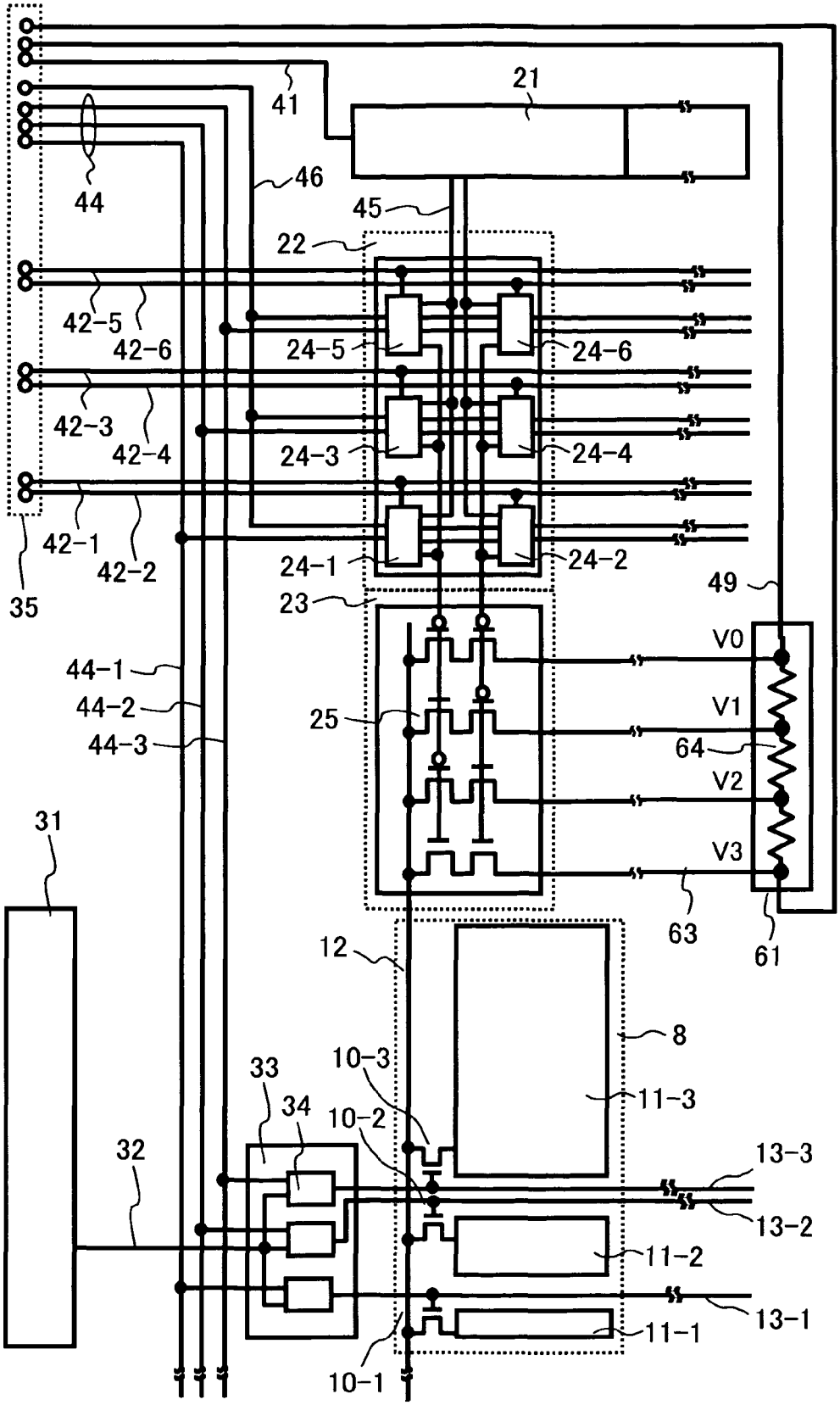
FIG. 2 is a schematic block diagram of a display panel according to the embodiment of the invention.

Referring to FIG. 2, the display-data holding circuit 22 and the gray-level-voltage selecting circuit 23 will be described. Six-bit display data is input to the display-data holding circuit 22 of the display panel 1 from the exterior via a terminal section 35 and display data lines 42-1 to 42-6. The display-data holding circuit 22 holds the display data in bit-data holding circuits 24 according to the timing signals input from the horizontal shift register 21 through timing signal lines 45.

In this embodiment, the display data has six bits. A bit-data holding circuit 24-1 holds the first-bit display data, and a bit-data holding circuit 24-2 holds the second-bit display data. The bit-data holding circuits 24 thus hold display data up to the sixth-bit display data. The display data is not limited to the 6-bit data, it depends on the levels of gray.

The display data is held in the bit-data holding circuits 24, and then output to the gray-level-voltage selecting circuit 23. The gray-level-voltage selecting circuit 23 includes selection switching elements 25. The display data is input to the control terminals of the selection switching elements 25 every two bits. The gray-level-voltage selecting circuit 23 is also supplied with gray-level voltage from the gray-level voltage generating circuit 61. Gray-level voltage is selected by the selection switching elements 25 in accordance with the display data output from the bit-data holding circuits 24 and output to the video signal line 12.

The gray-level voltage output from the gray-level-voltage selecting circuit 23 is supplied to the pixel electrode 11 via the video signal line 12 and the switching elements 10. The pixel electrode 11 configures one pixel section by three electrodes having different areas. A pixel electrode 11-2 is configured so that the light transmitted or reflected for display is four times in intensity as high as that of a pixel electrode 11-1 at the same voltage. A pixel electrode 11-3 is configured so that the light transmitted or reflected for display is four times in intensity as high as that of a pixel electrode 11-2 at the same voltage.

The control terminals of the three switching elements 10 in the pixel section 8 connect to the scanning signal lines 13. Three scanning signal lines 13-1, 13-2, and 13-3 are input to each pixel section 8. The scanning signal lines 13 are output from a scanning-signal dividing circuit 33. The vertical shift register 31 outputs a scanning signal to the scanning-signal dividing circuit 33 through a scanning-signal output line 32 every scanning period (1H). The scanning-signal dividing circuit 33 includes a division operating circuit 34, which carries out an operation between the dividing signals input through dividing signal lines 44 and the scanning signals, and outputs divided scanning signals to the scanning signal lines 13.

Figure 3:
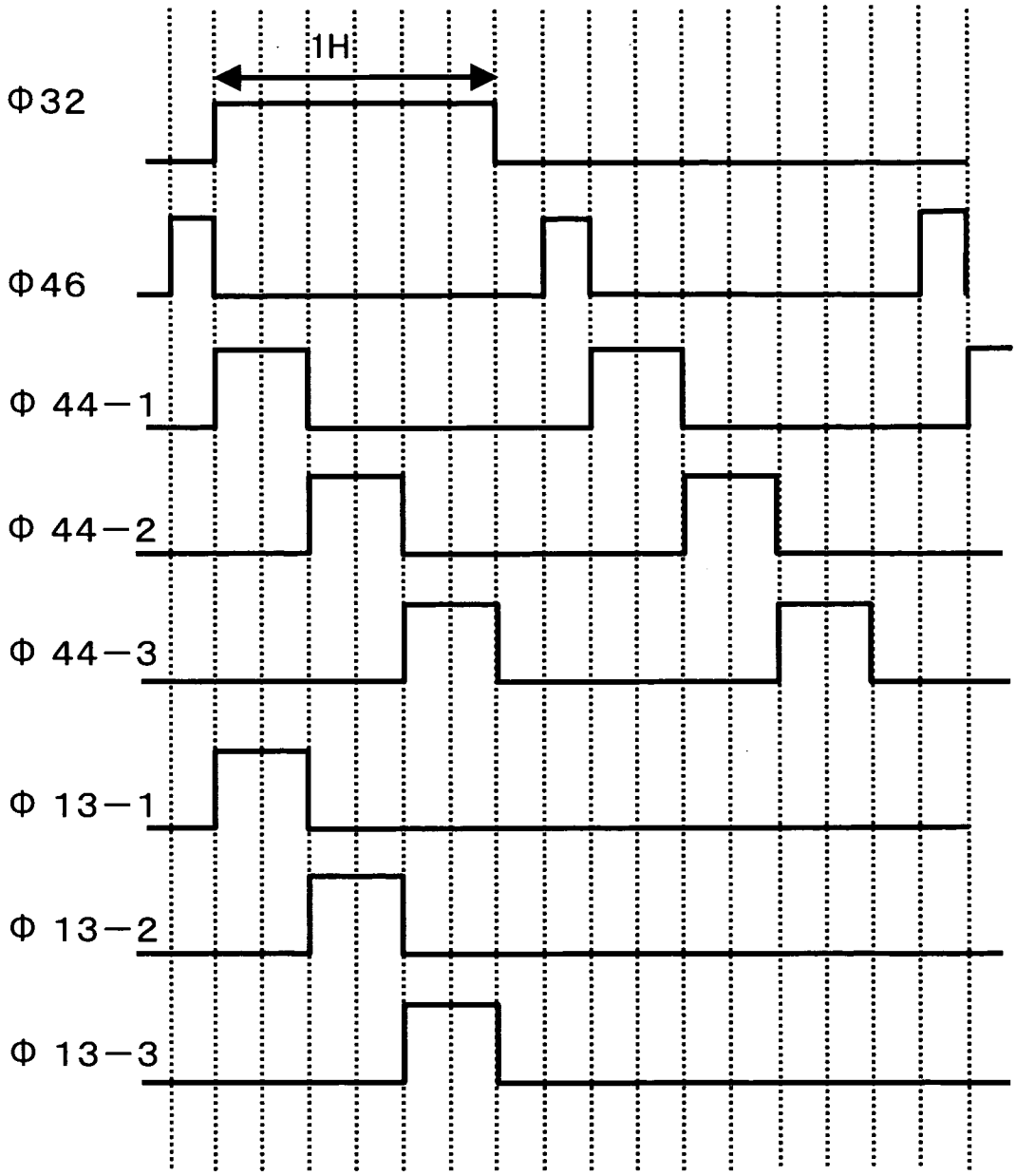
FIG. 3 is a timing chart of operations according to the embodiment of the invention.

FIG. 3 shows a timing chart of the divided scanning signals. Divided signals Φ44-1, Φ44-2, and Φ44-3 are supplied in sequence such as to divide one scanning period (1H) into three, and are input to the bit-data holding circuits 24 and the division operating circuit 34. The division operating circuit 34 carries out an operation between a shift register output signal Φ32 and the divided signals Φ444, and output divided scanning signals Φ13-1, Φ13-2, and Φ13-3 to the scanning signal lines 13.

A transfer signal Φ46 is supplied to the bit-data holding circuit 24, which shows the timing to transfer display data in the display-data holding circuit 22. The divided signals Φ44 can also control the timing to output display data from the display-data holding circuit 22 to the gray-level-voltage selecting circuit 23. Therefore, the timing at which the pixel electrode 11 is selected according to the divided scanning signals Φ13 and the timing at which gray-level voltage is output from the gray-level-voltage selecting circuit 23 can be agreed with each other.

Figure 4:
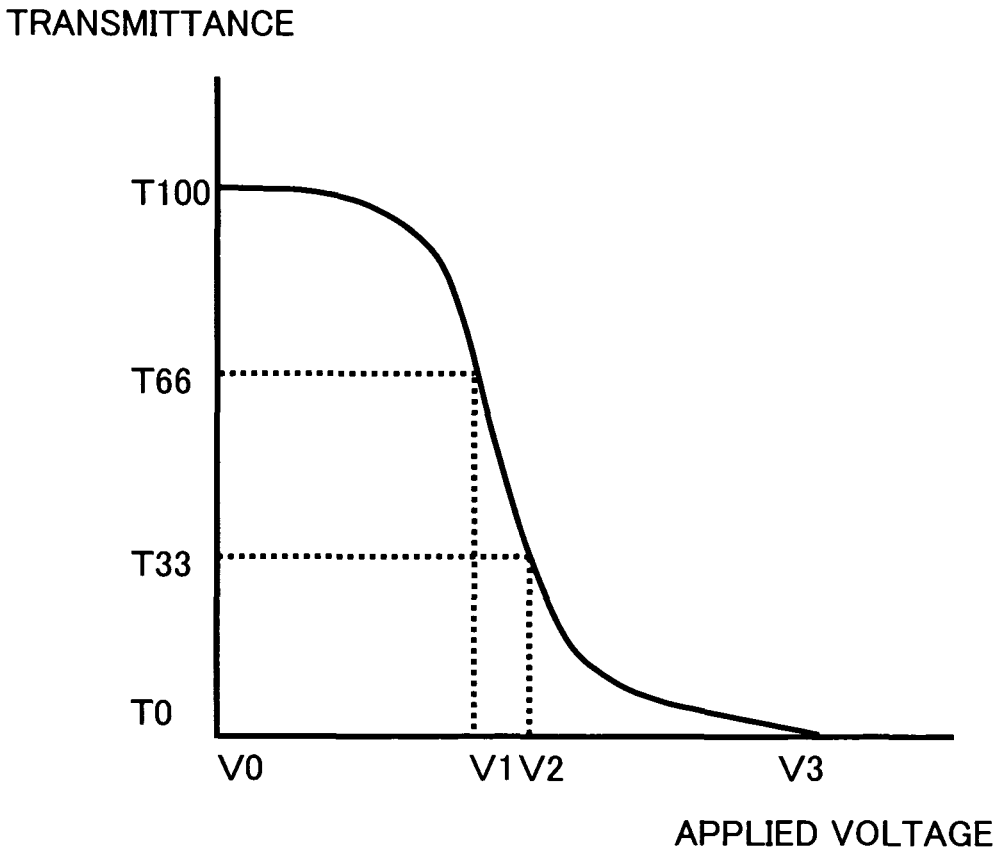
FIG. 4 is a graph showing the relationship between applied voltage and transmittance.

The relationship between the gray-level voltage supplied to the pixel electrodes 11 and the area of the pixel electrode 11 will be described. FIG. 4 shows the relationship between the voltage applied to the pixel electrodes and the transmittance of the liquid crystal. FIG. 4 shows the case of normally white in which transmittance is the maximum (T100) when no voltage is applied, which plots the transmittance of each subpixel in ordinate and gray-level voltage applied to the pixel electrode in abscissa.

FIG. 4 shows that the gray-level voltage at which the transmittance is the minimum (T0) is V3, the gray-level voltage at which the transmittance is 33 percent of transmittance T100 is V2, the gray-level voltage at which the transmittance is 66 percent of transmittance T100 is V1, and the gray-level voltage at which the transmittance is T100 is V0.

In this embodiment, one pixel section is composed of three subpixels with the effective area ratio of 1:4:16. Therefore, when gray-level voltage V0 is applied to the pixel electrodes 11, the ratio of the intensity of lights transmitted from or reflected by the subpixels to be used for display becomes 1:4:16.

As shown in FIG. 2, the gray-level voltage generating circuit 61 generates voltages V0, V1, V2, and V3 with a ladder resistor 64, from which voltages V0, V1, V2, and V3 are applied to the gray-level-voltage selecting circuit 23. In FIG. 2, voltages V0 and V3 can be supplied from the exterior through the terminal section 35 and voltage supply lines 49.

The gray-level-voltage selecting circuit 23 includes the selection switching elements 25, with which one of the voltages V0, V1, V2, and V3 is selected and output to the video signal line 12. To the selection switching elements 25, display data is transmitted from the bit-data holding circuit 24 every two bits. When the low-order bit of the 2-bit display data transmitted from the bit-data holding circuit 24 is 0 and the high-order bit is 0 (0, 0), the voltage V3 is selected; when the low-order bit is 1 and the high-order bit is 0 (1, 0), the voltage V2 is selected; when the low-order bit is 0 and the high-order bit is 1 (0, 1), the voltage V1 is selected; and when the low-order bit is 1 and the high-order bit is 1 (1, 1), the voltage V0 is selected.

For example, when the voltage V2 is written to the pixel electrode 11-1, the switching element 10-1 is turned on through the divided scanning signal line 13-1 to electrically connect the video signal line 12 with the pixel electrode 11-1, thereby transmitting display data (1, 0) from the bit-data holding circuits 24-1 and 24-2 to the gray-level-voltage selecting circuit 23. Then the voltage V2 is output to the video signal lines 12, so that the voltage V2 is written to the pixel electrode 11-1.

The effective area ratio of the three subpixels is 1:4:16. Accordingly, assuming that the gray level when the voltage V2 is written to the pixel electrode 11-1 is 1, the gray level when the voltage V2 is written to the pixel electrode 11-2 becomes 4, and the gray level when the voltage V2 is written to the pixel electrode 11-3 becomes 16.

The writing of the voltages V3 to V0 to the pixel electrode 11-1 allows gray levels 0 to 3 to be assigned; the writing of voltages V3 to V0 to the pixel electrodes 11-1 and 11-2 allows gray levels 4 to 15 to be assigned; and the writing of voltages V3 to V0 to the pixel electrodes 11-1, 11-2, and 11-3 allows gray levels 16 to 63 to be assigned.

When the effective area ratio of the $i^{th}$ subpixel to the $i+1^{th}$ subpixel is 1:n, the display data is divided into data of n levels of gray, and a voltage for n levels of gray is supplied to the $i^{th}$ subpixel and also to the $i+1^{th}$ subpixel, thereby allowing gray levels to be assigned by gray-level voltage in combination with the gray-level assigning according to the area ratio.

The configuration of this embodiment allows the gray-level-voltage selecting circuit 23 to have a compact circuit configuration in which a voltage for n levels of gray is dividedly output from display data to the $i^{th}$ subpixel and the $i+1^{th}$ subpixel. Sharing the selection switching elements 25 for outputting a voltage for n levels of gray by the $i^{th}$ subpixel and the $i+1^{th}$ subpixel allows the scale of the circuit configuration to be reduced.

Figure 5:
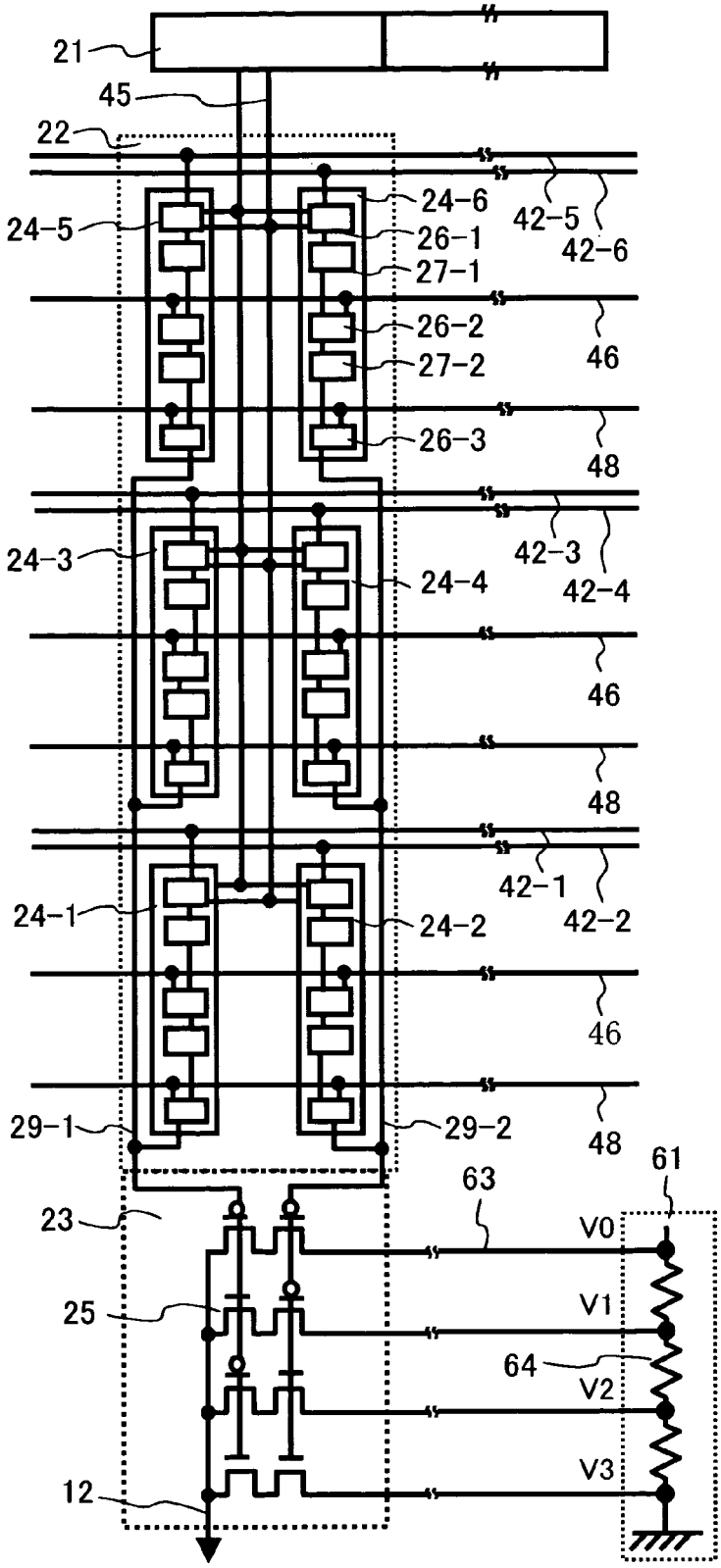
FIG. 5 is a schematic block diagram of a display panel according to the embodiment of the invention.

Referring now to FIG. 5, the display-data holding circuit 22 and the bit-data holding circuits 24 will be described. The display-data holding circuit 22 includes the bit-data holding circuits 24 corresponding to the number of the bit of the display data. The bit-data holding circuits 24 are configured to output display data to the gray-level-voltage selecting circuit 23 in groups of k bits that satisfy $2^k=n$ when the effective area ratio of the $i^{th}$ subpixel to the $i+1^{th}$ subpixel is 1:n.

In FIG. 5, the bit-data holding circuits 24 are to be one group every two bits and three groups are arranged vertically. Each bit-data holding circuit 24 includes a first transfer element 26-1, a first holding element 27-1, a second transfer element 26-2, a second holding element 27-2, and a third transfer element 26-3.

In the display-data holding circuit 22, when a timing signal is transmitted from the horizontal shift register 21 through the timing signal line 45 to each bit-data holding circuit 24, the first transfer circuit 26-1 is turned on, so that the value of the bits of the display data is transmitted through the display data line 42 to the first holding element 27-1. Then, when the first transfer element 26-1 is turned off, the display data is held in the first holding element 27-1.

Next, when display data of one line is held in the first holding element 27-1, a transfer signal is transmitted through a transfer signal line 46 to the second transfer element 26-2, so that the bit-by-bit display data held in the first holding element 27-1 is transferred to the second holding element 27-2.

The provision of the first holding element 27-1 and the second holding element 27-2 allows the display data of the next line to be written to the first holding element 27-1 while the second holding element 27-2 is outputting display data. In this embodiment, the display data is output to the gray-level-voltage selecting circuit 23 three times every two bits during one scanning period.

As shown in FIG. 5, the bit-data holding circuit 24 has the holding elements 27 arranged vertically by one bit, so that the holding elements 27 can be arranged vertically along the extension of the video signal line 12.

Moreover, the display data is output to the gray-level-voltage selecting circuit 23 in such a manner that it is divided by two bits in three times during one scanning line. Thus, a group of the bit-data holding circuits 24 of the first and second bits, a group of the bit-data holding circuits 24 of the third and fourth bits, and a group of the bit-data holding circuits 24 of the fifth and sixth bits are arranged vertically (in the Y direction in FIG. 5). The group of the bit-data holding circuits 24 and the gray-level-voltage selecting circuit 23 are connected together through the bit data lines 29-1 and 29-2.

The connecting of the group of the bit-data holding circuits 24 arranged vertically with the gray-level-voltage selecting circuit 23 through the bit data lines 29-1 and 29-2 allows the data in the vertically arranged bit-data holding circuits 24 to be transmitted to the gray-level-voltage selecting circuit 23.

Figure 6:
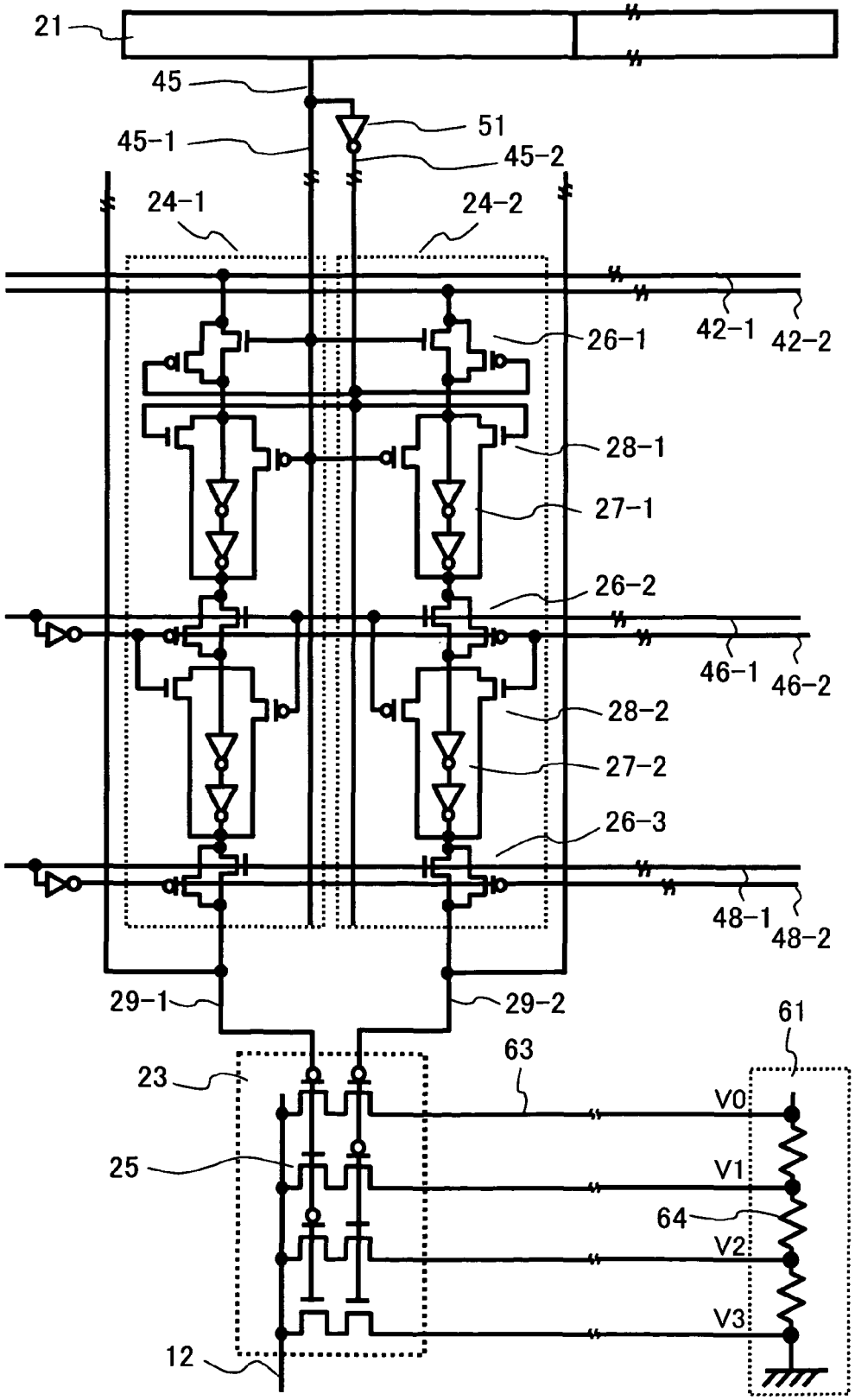
FIG. 6 is a schematic block diagram of a display panel according to the embodiment of the invention.
Figure 7:
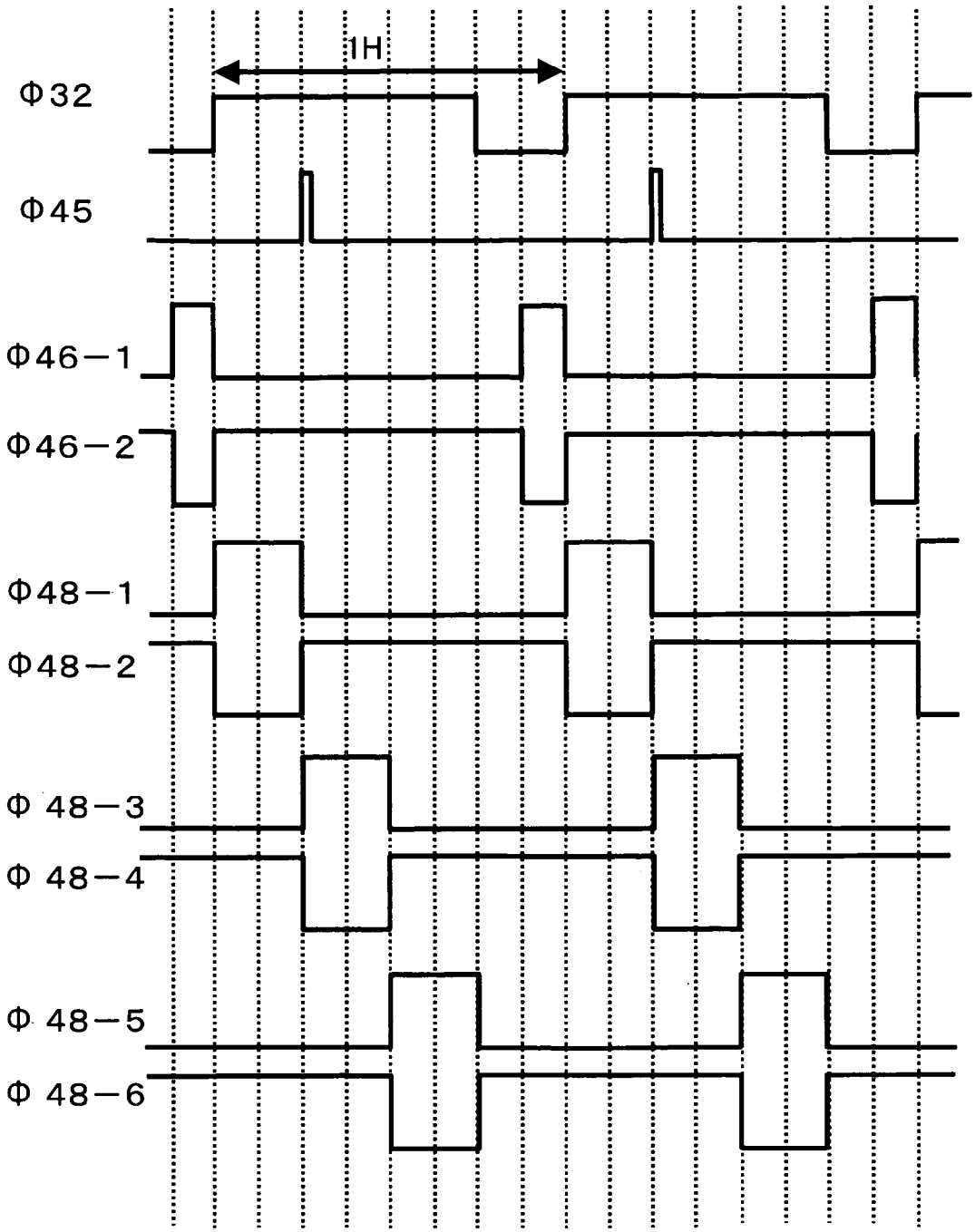
FIG. 7 is a timing chart of operations according to the embodiment of the invention.

Referring to FIGS. 6 and 7, the transfer elements 26, the holding elements 27, and their operation will be described. The first transfer element 26-1 is an analog switch composed of an nMOS transistor and a pMOS transistor. The display data line 42 is connected to one terminal of the first transfer element 26-1, and the other terminal of the first transfer element 26-1 is connected to the input terminal of the first holding element 27-1.

As shown in FIG. 7, a timing signal Φ45 is output from the horizontal shift register, the first transfer element 26-1 in FIG. 6 is turned on, so that display data is transferred to the first holding element 27-1 through the display data line 42. The timing signal line 45 includes an inverter 51, so that an inverted signal of the timing signal is output to the timing signal line 45-2. Upon output of the timing signal Φ45, the nMOS transistor of the analog switch is turned on through the timing signal line 45-1, and the pMOS transistor of the analog switch is turned on through the timing signal line 45-2.

The timing signal Φ45 of FIG. 7 is output to the $m^{th}$ timing signal line 45. When the number of the horizontal pixels of the display device is 3,840 (=1,280×3), timing signals Φ45 of 3,840 stages are output.

When the first transfer element 26-1 is in ON position, so that the display data is input to the first holding element 27-1, the output of the first holding element 27-1 including two inverters connected in series has the same value as the display data. Upon completion of the output of the timing signal Φ45, the first transfer element 26-1 is turned off. At that time, the switching element 28-1 connecting the input and output of the first holding element 27-1 is turned on to connect the input and output of the first holding element 27-1, so that the display data input to the holding elements 27 is held.

Next, when a transfer signal Φ146 is input to the second transfer element 26-2, the display data held in the holding element 27-1 of one line is input to a second holding element 27-2. Subsequently, the output of the transfer signal Φ46 is stopped so that the display data is held in the second holding elements 27-2.

After the output of the transfer signal Φ46 is stopped to shut off the electrical connection between the first holding element 27-1 and the second holding element 27-2, a division transfer signal Φ48 is input to a third transfer element 26-3 so as to divide one scanning line (1H) into three, thereby outputting the display data from the bit-data holding circuit 24 to the gray-level-voltage selecting circuit 23 every two bits through the bit data lines 29-1 and 29-2.

The first-bit and second-bit display data are output from the bit-data holding circuits 24-1 and 24-2 to the gray-level-voltage selecting circuit 23 according to division transfer signals Φ48-1 and Φ48-2; the third-bit and fourth-bit display data are output from the bit-data holding circuits 24-3 and 24-4 to the gray-level-voltage selecting circuit 23 according to division transfer signals Φ48-3 and Φ48-4; and the fifth-bit and sixth-bit display data are output from the bit-data holding circuits 24-5 and 24-6 to the gray-level-voltage selecting circuit 23 according to division transfer signals Φ48-5 and Φ48-6.

Figure 8:
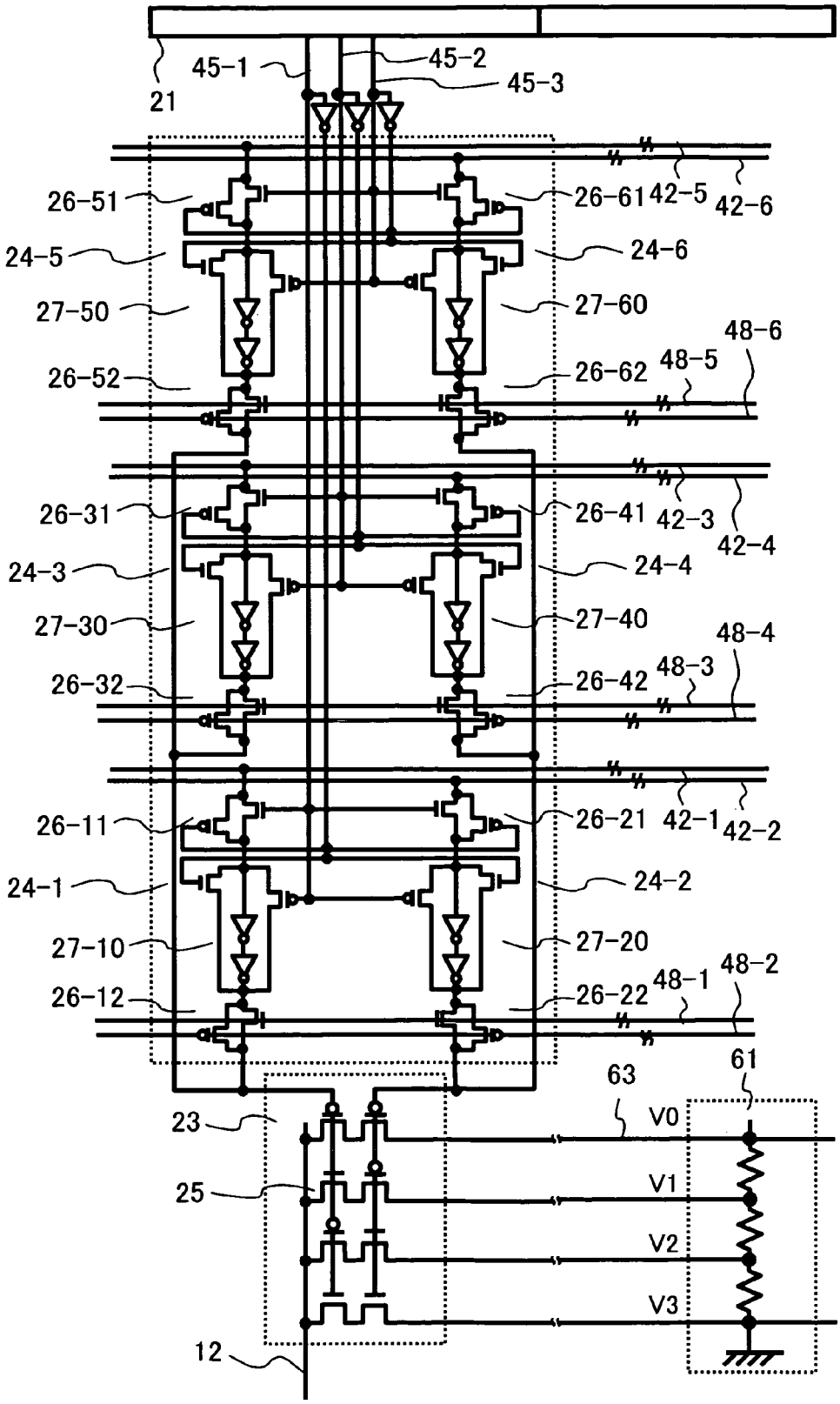
FIG. 8 is a schematic block diagram of a display panel according to the embodiment of the invention.
Figure 9:
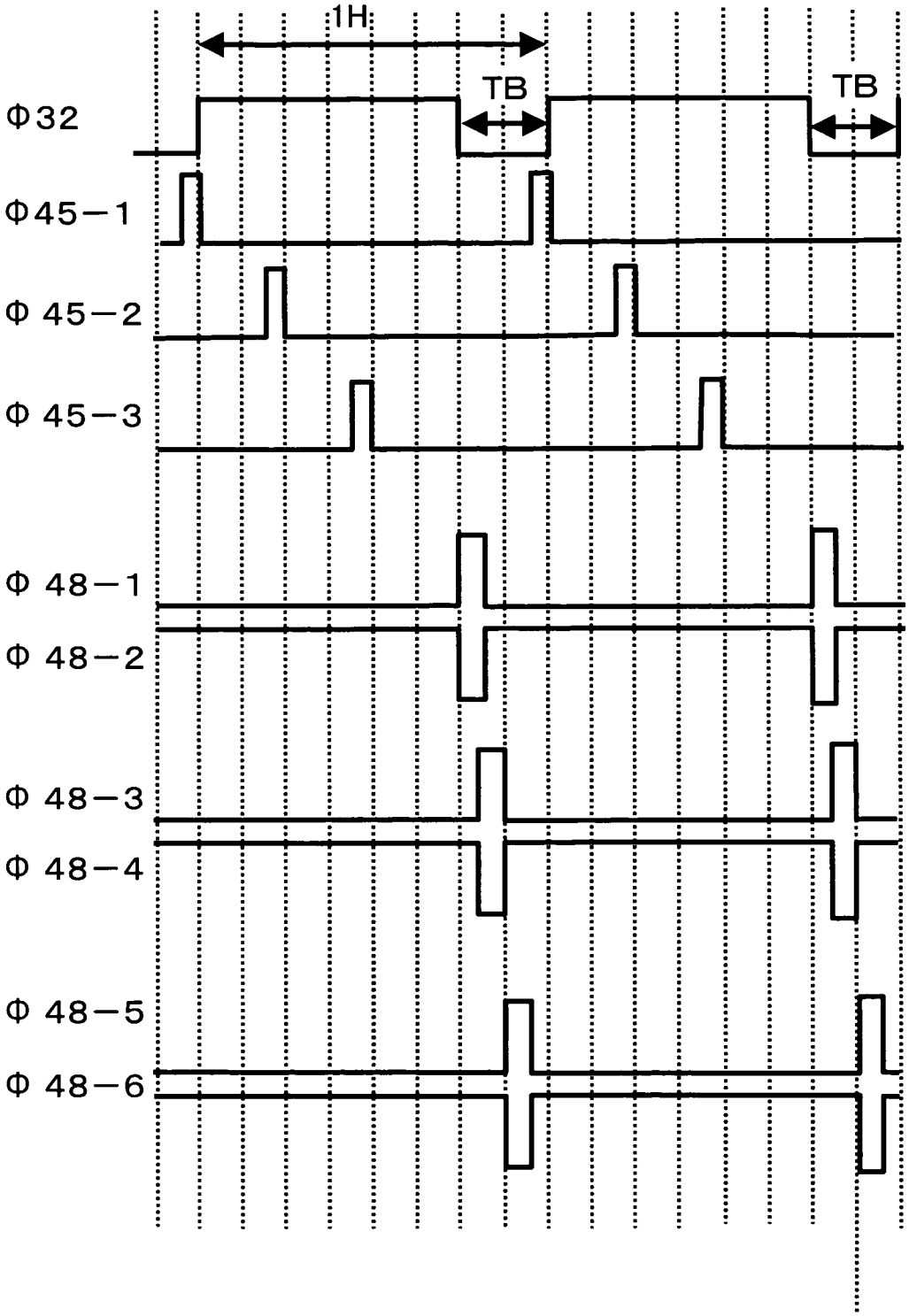
FIG. 9 is a timing chart of operations according to the embodiment of the invention.

FIG. 8 shows a circuit configuration including three stages of the holding elements 27. FIG. 9 shows the timing chart of the circuit of FIG. 8. The horizontal shift register 21 outputs a timing signal Φ45-1 for the bit-data holding circuits 24-1 and 24-2, a timing signal Φ45-2 for the bit-data holding circuits 24-3 and 24-4, and a timing signal Φ45-3 for the bit-data holding circuits 24-5 and 24-6.

The timing signals Φ45-1, Φ45-2, Φ45-3 are output in 3,840 stages when the number of horizontal pixels of the display device is 1,280×3=3,840.

As shown in FIG. 9, the timing signal Φ45-1 is output to turn on the first transfer elements 26-11 and 26-21, thereby inputting display data to the first holding elements 27-10 and 27-20, and then the output of the timing signal Φ45-1 is stopped so that the display data is held in the first holding elements 27-10 and 27-20. Subsequently, division transfer signals Φ48-1 and Φ48-2 are output during the blanking period TB to output the first-bit and second-bit display data from the bit-data holding circuits 24-1 and 24-2 to the gray-level-voltage selecting circuit 23.

Next, the output of the division transfer signals Φ48-1 and Φ48-2 is stopped, and the timing signal Φ45-2 is output to turn on the first transfer signals 26-31 and 26-41, thereby inputting display data to the first holding elements 27-30 and 27-40, and the output of the timing signal Φ45-2 is stopped so that the display data is held in the first holding elements 27-30 and 27-40. Subsequently, division transfer signals Φ48-3 and Φ48-4 are output during the blanking period TB to output the third-bit and fourth-bit display data from the bit-data holding circuits 24-3 and 24-4 to the gray-level-voltage selecting circuit 23.

Subsequently, the output of the division transfer signals Φ48-3 and Φ48-4 is stopped, and the timing signal Φ45-3 is output to turn on the first transfer signals 26-51 and 26-61, thereby inputting display data to the first holding elements 27-50 and 27-60, and the output of the timing signal Φ45-3 is stopped so that the display data is held in the first holding elements 27-50 and 27-60. Subsequently, division transfer signals Φ48-5 and Φ48-6 are output during the blanking period TB to output the fifth-bit and sixth-bit display data from the bit-data holding circuits 24-5 and 24-6 to the gray-level-voltage selecting circuit 23.

Figure 10:
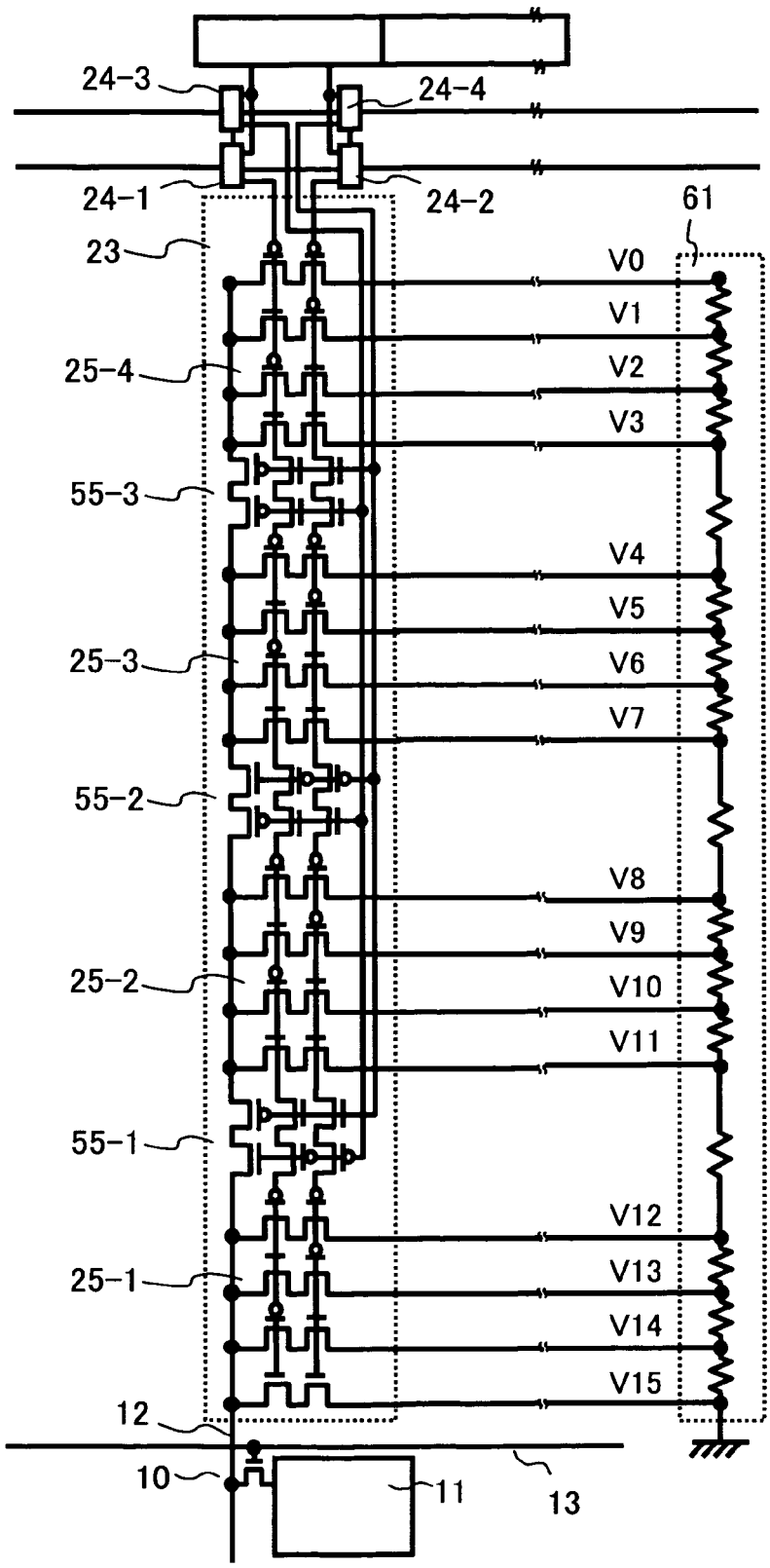
FIG. 10 is a schematic block diagram of a display panel according to the embodiment of the invention.

Referring now to FIG. 10, the output of voltage for 16 levels of gray will be described. FIG. 10 shows a case in which 4-bit data is input from the bit-data holding circuit 24 to the gray-level-voltage selecting circuit 23 to output voltage for 16 levels of gray on the basis of 4-bit data.

The selection switching elements 25 of the gray-level-voltage selecting circuit 23 are arranged vertically in four stages in groups of elements for low-order 2 bit data. Between the stages, a high-order-bit switching element 55 is disposed.

The vertical arrangement of the high-order-bit switching element 55 and the gray-level-voltage selecting circuit 23 allows the gray-level-voltage selecting circuit 23 to be disposed in a narrow-width range on the extension of the video signal lines 12.

A selection switching elements 25-1 allows selection of one to four levels of gray, a selection switching elements 25-2 and a high-order-bit switching element 55-1 allow selection of five to eight levels of gray, a selection switching elements 25-3 and a high-order-bit switching element 55-2 allow selection of nine to 12 levels of gray, and a selection switching elements 25-4 and a high-order-bit switching element 55-3 allow selection of 13 to 16 levels of gray.

Figure 11:
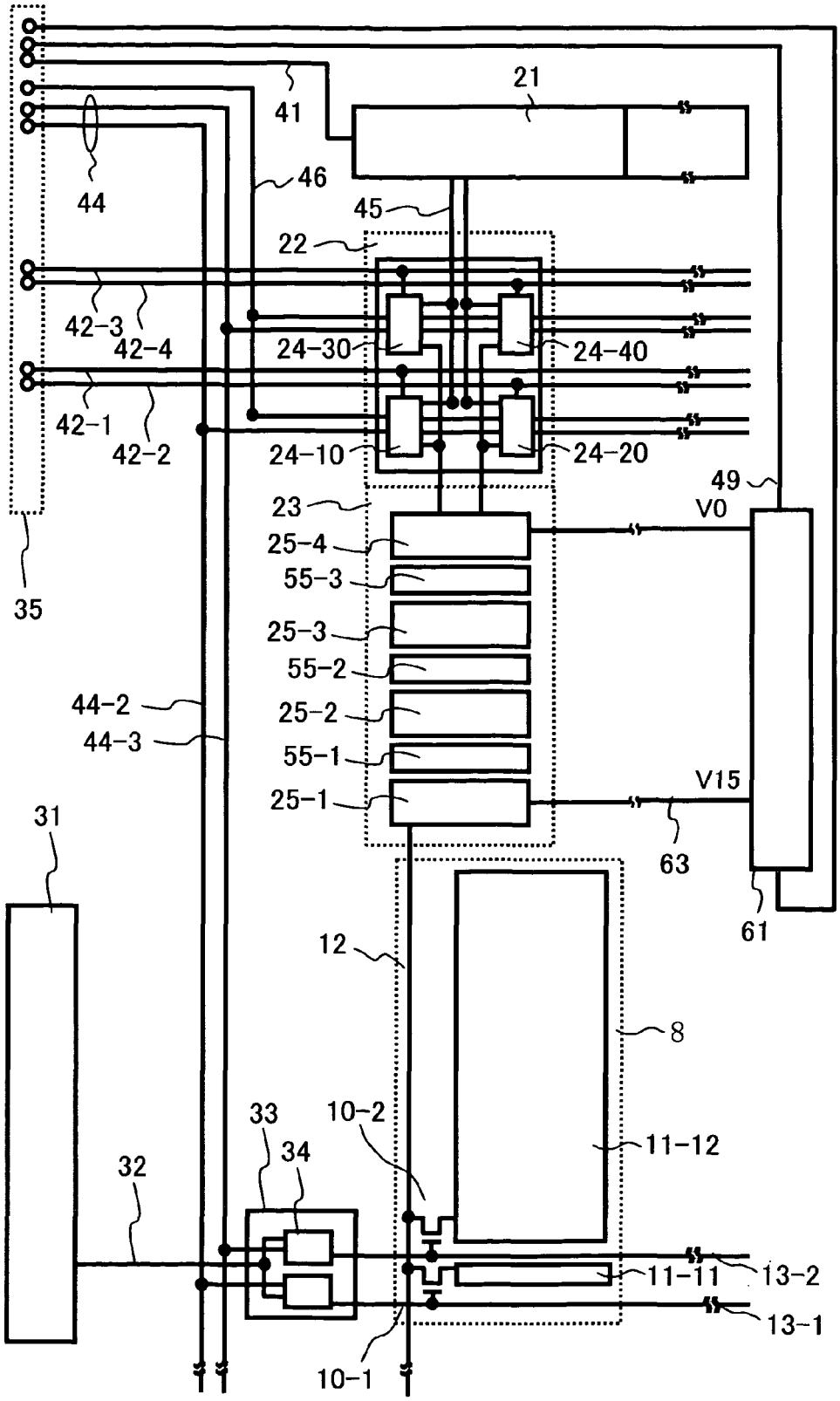
FIG. 11 is a schematic block diagram of a display panel according to the embodiment of the invention.

FIG. 11 shows a case where one pixel section is composed of two subpixels with an effective area ratio of 1:16. The ratio of the intensity of light transmitted through or reflected by each subpixel for display when gray-level voltage V0 is applied to the pixel electrode 11-12 to that when gray-level voltage V0 is applied to the pixel electrode 11-12 is 1:16.

With the display panel shown in FIG. 11, 16 levels of gray are output from the gray-level-voltage selecting circuit 23 and 16 levels of gray can be produced owing to the area ratio, allowing 16×16=256 levels of gray to be provided.

The bit-data holding circuit 24-10 holds the first- and second-bit display data; the bit-data holding circuit 24-20 holds the third- and fourth-bit display data; the bit-data holding circuit 24-30 holds the fifth- and sixth-bit display data; and the bit-data holding circuit 24-40 holds the seventh- and eighth-bit display data.

One scanning period is divided into two by the dividing signal line 44. During a first period, the display data is output from the bit-data holding circuits 24-10 and the 24-20 to the gray-level-voltage selecting circuit 23, and at the same time, a scanning signal is output to the scanning signal line 13-1 so that the switching element 10-1 is turned on.

During a second period, the display data is output from the bit-data holding circuits 24-30 and the 24-40 to the gray-level-voltage selecting circuit 23, and at the same time, a scanning signal is output to the scanning signal line 13-2 so that the switching element 10-2 is turned on.

Figure 12:
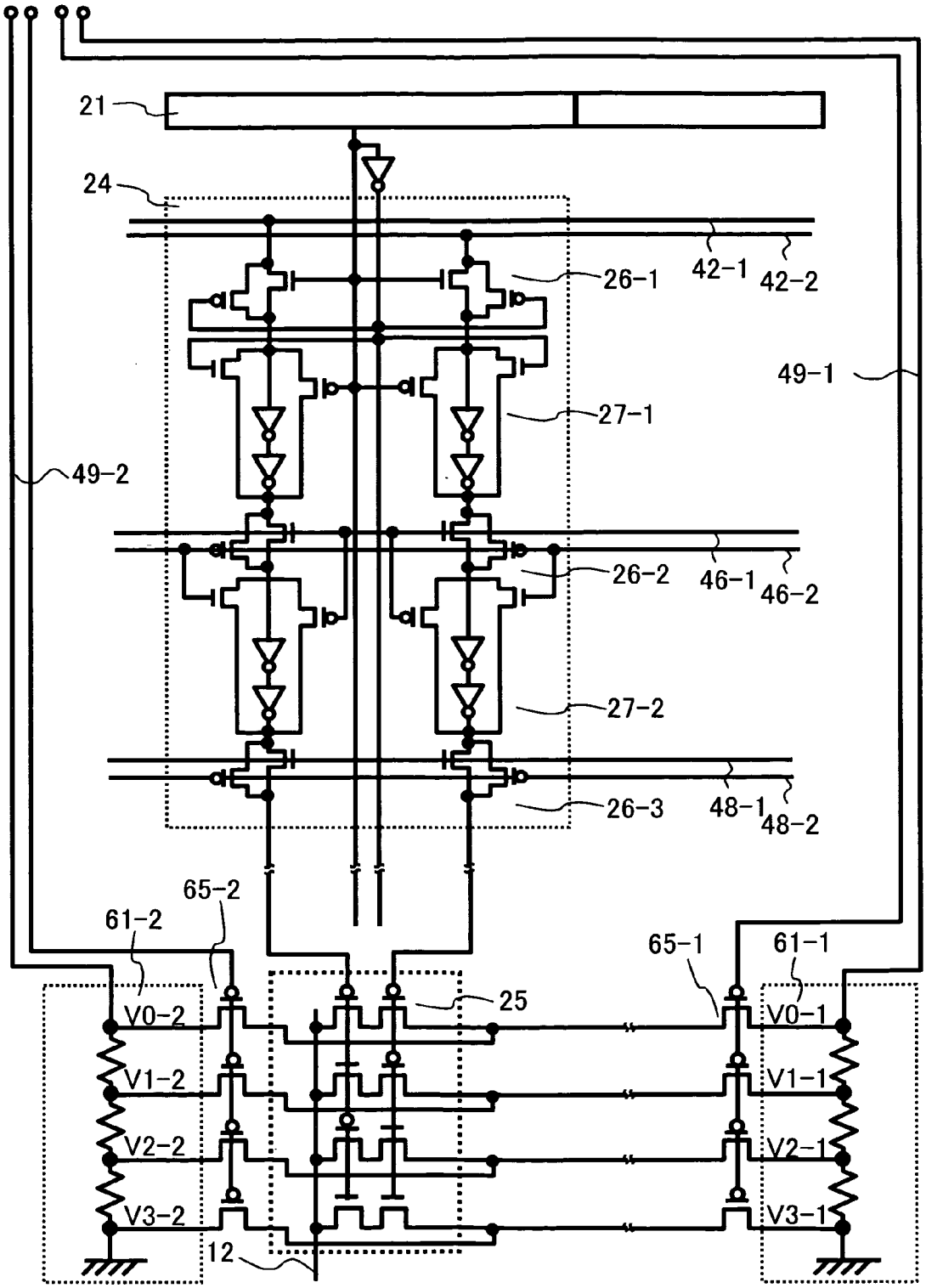
FIG. 12 is a schematic block diagram of a display panel according to the embodiment of the invention.

Referring to FIG. 12, a configuration for gamma correction will be described. The configuration of FIG. 12 has a plurality of gray-level voltage generating circuits 61, allowing two or more kinds of gray-level voltage to be output.

The plurality of gray-level voltage generating circuits 61 allow application of different gray-level voltages even if the pixel electrodes 11-1 and 11-2 input the same 2-bit data to the gray-level-voltage selecting circuit 23.

Specifically, even if the 2-bit data has the same value (1, 1), this configuration allows application of voltage V0-1 to the video signal line 12 by turning on a ladder-resistor selecting element 65-1, and application of voltage V0-2 to the video signal line 12 by turning on a ladder-resistor selecting element 65-2.

For example, differentiating the difference between the voltages V0-1 and V1-1 and the difference between the voltages V0-2 and V1-2 allows changes in gray level between higher levels and lower levels to be brought close to evenness for human eyes.

Referring to FIGS. 13 to 16, the configuration of a pixel region including a memory circuit will be described.

Figure 13:
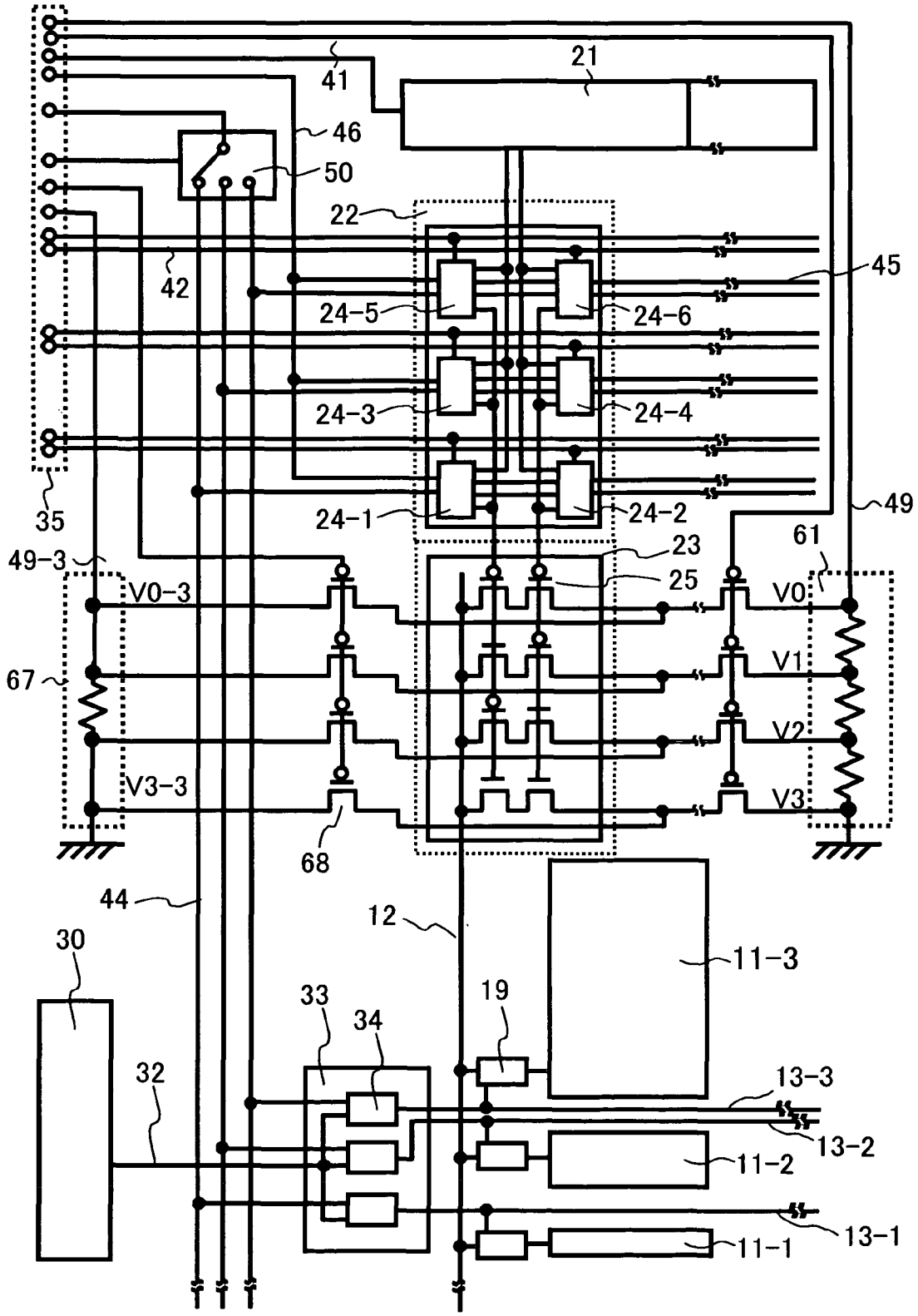
FIG. 13 is a schematic block diagram of a display panel according to the embodiment of the invention.

The display panel shown in FIG. 13 includes a binary-signal ladder resistor. When the high-order bit of the two bits held in the bit-data holding circuits 24 is 1, it outputs a high-level voltage V0-3; when the high-order bit is 0, it outputs a low-level voltage V3-3 (0V).

The pixel section 8 includes pixel memory elements 19. In the case of displaying a still image for a long time, it is performed via the pixel memory elements 19.

Figure 14:
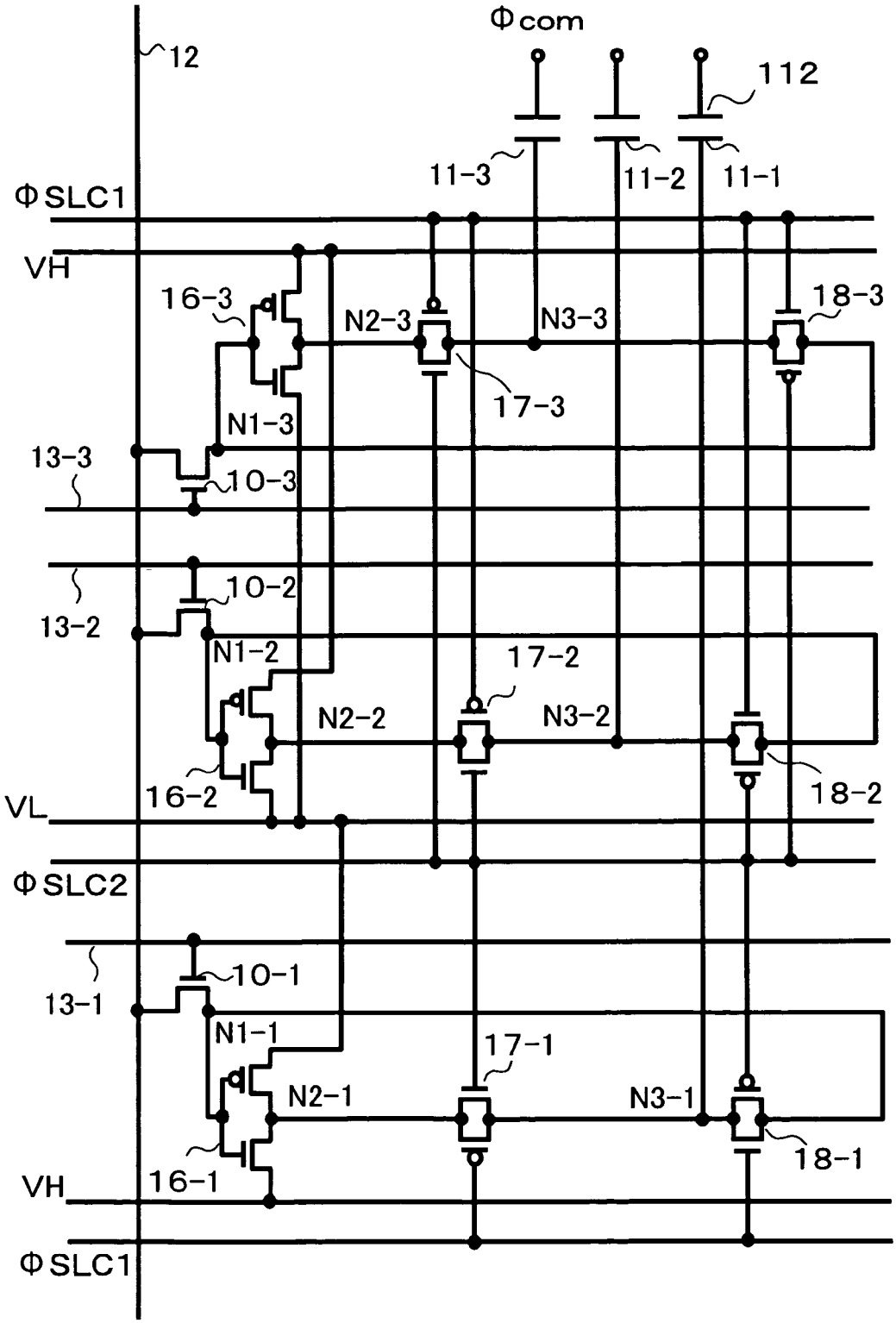
FIG. 14 is a schematic block diagram of a display panel according to the embodiment of the invention.

FIG. 14 shows the circuit configuration of the unit pixel memory of the invention. As has been described, numeral 10 denotes a switching element, and 11 indicates a pixel electrode. An opposing electrode 112 is opposed to the pixel electrode. A clock pulse Φcom that periodically rises and falls in signal voltage is applied to the opposing electrode 112.

The ON-OFF of the switching elements 10 is controlled by the scanning signal through the scanning signal line 13. FIG. 14 shows the n-type transistors of the switching elements 10, so that the switching elements 10 are brought into conduction with the scanning signal at a high level and into high resistance at a low level. When the switching elements 10 are turned on, the video signal transmitted through the video signal line 12 is transmitted to nodes N1.

In FIG. 14, there are two passage for transmitting the video signal from the switching element 10 to the pixel electrode 11, one of which is input to an inverter circuit 16 composed of a CMOS transistor via a node N1, and passes through a node N2, an analog switch 17, and a node N3 into the pixel electrode 11. The other passes through the node N1, the analog switch 18, and the node N3 into the pixel electrode 11.

A high-level voltage VH and a low-level voltage VL are input as a power source to the inverter circuit 16 composed of a CMOS transistor. The inverter circuit 16 outputs a voltage of the opposite polarity to that of the input signal; for example, when a low-level signal is input to the node N1, a high-level voltage VH is supplied to the node N2.

Between the node N2 and the node N3 is disposed the analog switch 17 whose on/off is controlled according to control pulses ΦSLC1 and ΦSLC2. Between the node N3 and the node N1 is disposed the analog switch 18 whose on/off is controlled according to control pulses ΦSLC1 and ΦSLC2.

The analog switch 17 and the analog switch 18 are each composed of an n-type transistor and a p-type transistor. When turned on according to the control pulses ΦSLC1 and ΦSLC2, the analog switches 17 and 18 are decreased in resistance to allow bidirectional transmission of signals. For example, when the analog switch 18 is in the ON position, signals can be transmitted either from the node N1 to the node N3 or from the node N3 to the node N1 according to the voltages of the node N1 and the node N3.

Whether the pixels are displayed in white or black depends on whether the polarity of the voltage at the node N3 connected to the pixel electrode 11 is the same as that of the clock pulse Φcom applied to the opposing electrode 112.

In a normally black mode, when the voltage of the node N3 has the same polarity as that of the clock pulse Φcom, the pixel is displayed in black; when the voltage of the node N3 has the opposite polarity to that of the clock pulse Φcom, the pixel is displayed in white.

A normally white mode is opposite to the above. This embodiment will be described for the normally black mode. While the embodiment will be described with a common alternating-current system in which a clock pulse whose polarity is inverted every screen (frame) is applied to the opposing electrode 112, this is also applicable to a case in which a constant voltage is applied to the opposing electrode 112.

Figure 15:
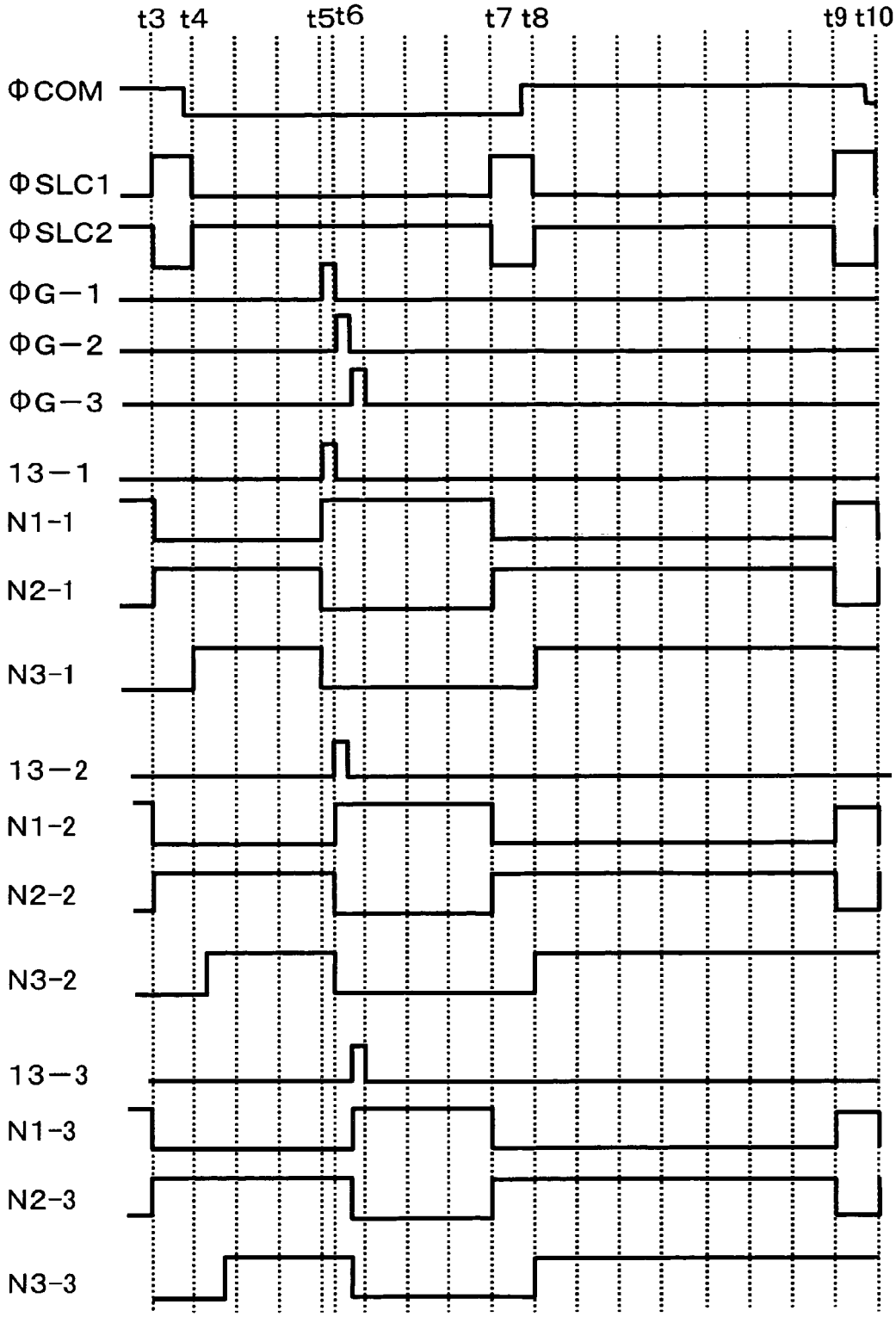
FIG. 15 is a timing chart of operations according to the embodiment of the invention.

The operation of the circuit shown in FIG. 14 during the operation of the memory will be described with reference to the timing chart of FIG. 15. Before time t3 of FIG. 15, when the voltages at nodes N3-1, N3-2, and N3-3 are at low level, and the clock pulse Φcom is at high level, the voltages of the pixel electrodes 11-1, 11-2, and 11-3 are at low level, and the voltages of the opposing electrodes 112 are at high level, in which the pixel electrodes 11 and the opposing electrodes 112 are opposite in polarity, so that the pixels are displayed in white.

When the pulse ΦSLC1 changes from low level to high level and the pulse ΦSLC2 changes from high level to low level at time t3, the analog switches 17-1, 17-2, and 17-3 between the nodes N2 and N3 of FIG. 14 are turned off, and the analog switches 18-1, 18-2, and 18-3 between the nodes N3 and N1 are turned on. The liquid-crystal capacitance between the pixel electrode 11 and the opposing electrode 112 can be designed to be sufficiently larger than the capacitance of the node N1, in which case the potential of the node N1 is changed to the same low level as that of the node N3 at the timing of time t3. At that time, the node N2 changes from low level to high level.

When the pulse ΦSLC1 changes from high level to low level and the pulse ΦSLC2 changes from high level to low level at time t4, the analog switches 17-1, 17-2, and 17-3 between the nodes N2 and N3 of FIG. 14 are turned on, and the analog switches 18-1, 18-2, and 18-3 between the nodes N3 and N1 are turned off. The node N3 comes to high level in a manner similar to the node N2 via the inverter circuit 16.

Before time t4, the pulse Φcom has changed from high level to low level. Accordingly, as described above, the white display is continued because the potential of the node N3 is opposite to that of the pulse Φcom.

At time t5, the scanning signal ΦG-1 in the scanning signal line 13-1 changes from low level to high level, so that the switching element 10-1 is turned on. Assume that the video signal line 12 is at high level (of the same polarity as that of the pulse Φcom and in black) according to the binary signal. The node N1-1 changes from low level to high level. Since the output of the inverter circuit 16-1 is at low level, the nodes N2-1 and N3-1 come to low level. Since the pulse Φcom at that time is at low level, the electric field applied to the liquid-crystal capacitance is 0 V, to change the pixel into black.

When the pulse ΦSLC1 changes from low level to high level and the pulse ΦSLC2 changes from high level to low level at time t7, the analog switch 17-1 between the nodes N2-1 and N3-1 is turned off, and the analog switch 18-1 between the nodes N3-1 and N1-1 is turned on. The potential of the node N1-1 is changed to the same low level as that of the node N3-1 at the timing of time t7. At that time, the node N2-1 changes from low level to high level.

When the pulse ΦSLC1 changes from high level to low level and the pulse ΦSLC2 changes from low level to high level at time t8, the analog switch 17-1 between the nodes N2-1 and N3-1 is turned on, and the analog switch 18-1 between the nodes N3-1 and N1-1 is turned off. The node N3-1 comes to high level in a manner similar to the node N2-1 via the inverter 16-1.

Before time t8, the pulse (com has changed from low level to high level. Accordingly, as described above, the potential of the node N3-1 is the same as that of the pulse Φcom, so that the black display is continued and the voltage inversion system for driving the liquid crystal becomes available.

When the pulse ΦSLC1 changes from low level to high level and the pulse ΦSLC2 changes from high level to low level at time t9, the analog switch 17-1 between the nodes N2-1 and N3-1 is turned off, and the analog switch 18-1 between the nodes N3-1 and N1-1 is turned on. The potential of the node N1-1 changes to the same high level as that of the node N3-1 at the timing t9. At that time, the node N2-1 changes from high level to low level.

When the pulse ΦSLC1 changes from high level to low level and the pulse ΦSLC2 changes from low level to high level at time t10, the analog switch 17-1 between the nodes N2-1 and N3-1 is turned on, and the analog switch 18-1 between the nodes N3-1 and N1-1 is turned off. At that time, the node N3-1 changes to low level as that of the node N2-1.

Before time t10, the pulse Φcom has changed from high level to low level. Accordingly, the potential of the node N3-1 is the same as that of the pulse Φcom, so that the black display is continued and alternating-current driving can be performed.

Thereafter, the above-described changes are repeated and the memory can be maintained to allow the display with alternating-current driving provided that the signals are not rewritten. The pixel memory elements 19 of the pixel electrodes 11-2 and 11-3 operate in the same way.

Since the effective area ratio of the subpixels including the pixel electrodes 11-1, 11-2, and 11-3 is 1:4:16, pseudo gray-level assigning is possible.

Figure 16:
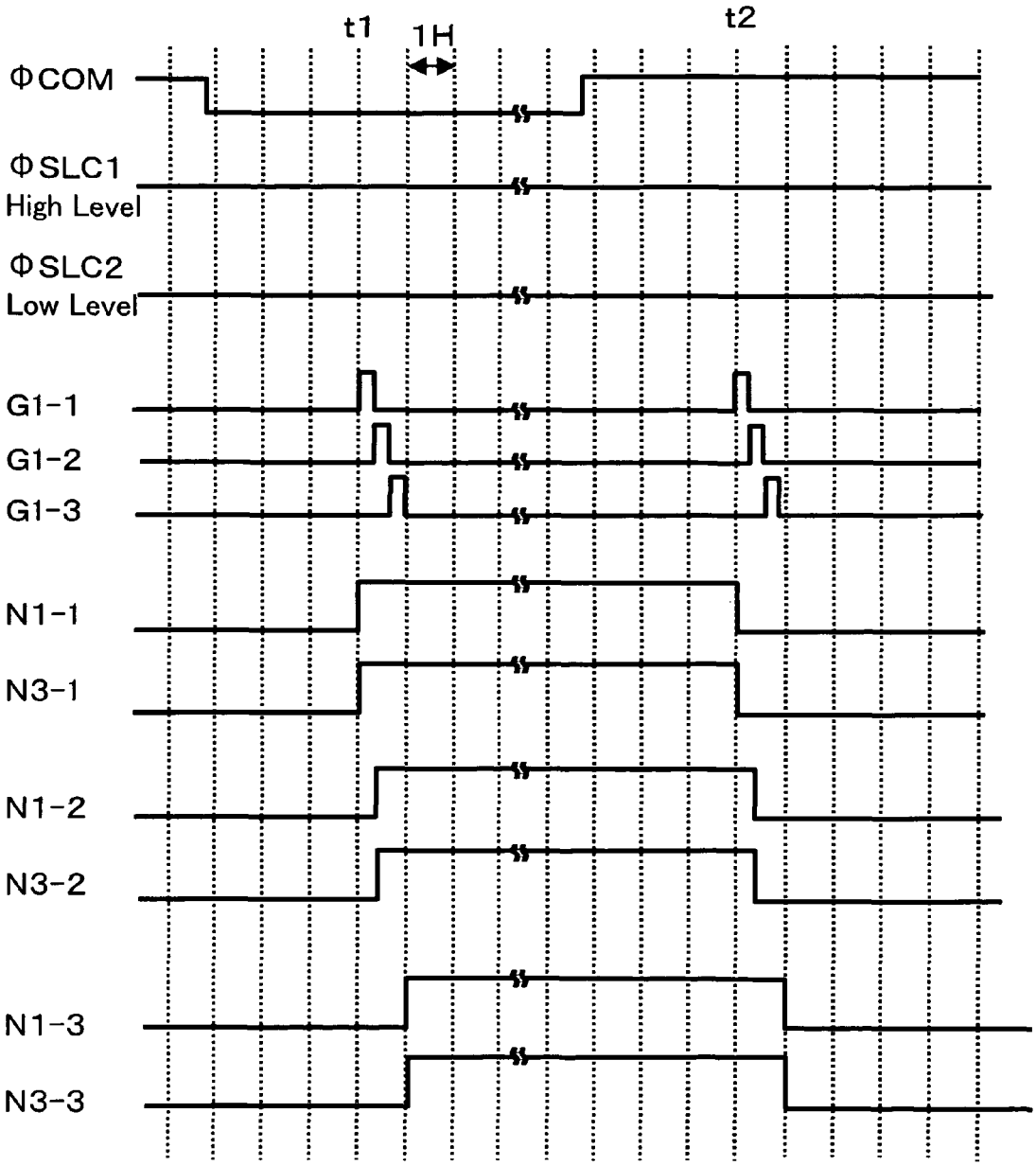
FIG. 16 is a timing chart of operations according to the embodiment of the invention.

FIG. 16 shows a timing chart for assigning gray levels by selecting and outputting a voltage from voltages V0 to V3 by the gray-level-voltage selecting circuit 23. For the gray-level assigning by voltage, the high-level voltage VH and the low-level voltage VL serving as the power supply for the memory are set at the same potential. This is for the purpose of preventing breakthrough current from flowing in the inverter circuit 16 whatever voltage the node N1 for the gate of the inverter circuit 16 is. Although any voltage is possible provided the high-level voltage VH and the low-level voltage VL have the same potential, the voltage in this embodiment is fixed to low level.

The control pulse ΦSLC1 is fixed to high level and the control pulse ΦSLC2 is fixed to low level. That is, the nodes N2 and N3 are interrupted from each other, and the nodes N1 and N3 are connected.

When the scanning signal ΦG-1 changes from low level to high level at time 1 in FIG. 16, the switching element 10-1 or a pixel transistor is turned on, so that the nodes N1-1 and N3-1 are provided with gray-level voltage generated by the gray-level voltage generating circuit 61 through the video signal line 12. Thus the pixel electrode 11-1 can be provided with the gray-level voltage as in a normal display operation.

The configuration in FIG. 13 allows binary data to be stored in the pixel memory 19, thereby allowing the pixels to be driven with alternating current without being rewritten through the video signal line 12. Moreover, this configuration can reduce the layout area necessary for the pixel memory to provide high open area ratio despite a multi-bit pixel memory.

What is claimed is:

1. A display device comprising:

a first substrate and a second substrate;

a plurality of pixel sections provided on the first substrate, opposing electrodes opposed to the pixel electrodes, switching elements for supplying a video signal to the pixel electrodes;

a video signal line for supplying a video signal to the switching elements;

a gray-level-voltage output circuit configured to output a video signal to the video signal line according to display data; and a scanning signal line for supplying a scanning signal for controlling the switching elements; wherein the pixel electrodes includes:

a first pixel electrode; and a second pixel electrode different in area from the first pixel electrode; and the gray-level-voltage output circuit includes:

a first group of holding circuits configured to hold a first bit and a second bit data of the display data corresponding to a video signal supplied to the first pixel electrode;

a second group of holding circuits configured to hold third bit and a fourth bit data of the display data corresponding to a video signal supplied to the second pixel electrode, and a gray-level voltage generating circuit configured to generate four gray-level voltages, wherein the first group of holding circuits and the second group of holding circuits are arranged to extend along the direction of extension of the video signal line, the first group of holding circuits includes a first holding circuit and a second holding circuit, the second group of holding circuits includes a third holding circuit and a fourth holding circuit, a first common bit data line electrically connects with the first holding circuit and the third holding circuit, a second common bit data line electrically connects with the second holding circuit and the fourth holding circuit, wherein an area ratio of the first pixel electrode to the second pixel electrode is 1:4, wherein the gray-level voltage generating circuit is configured to output one of the four gray-level voltages according to the bit data held in the first group of holding circuits, and output one of the four gray-level voltages according to the bit data held in the second group of holding circuits, the first common bit data line electrically connects with the gray level voltage generating circuit, and the second common bit data line electrically connects with the gray level voltage generating circuit.

2. The display device according to claim 1, wherein the second pixel electrode has an area substantively four times as high as that of the first pixel electrode.

3. The display device according to claim 1, wherein the first holding circuit includes two inverter circuits connected in series.

4. A display device comprising:

a first substrate and a second substrate;

a plurality of pixel sections provided on the first substrate, opposing electrodes opposed to the pixel electrodes, switching elements for supplying a video signal to the pixel electrodes;

a video signal line for supplying a video signal to the switching elements;

a gray-level-voltage circuit configured to output a video signal to the video signal line according to display data; and a scanning signal line for supplying a scanning signal for controlling the switching elements; wherein the pixel electrodes includes:

a first pixel electrode; and a second pixel electrode different in area from the first pixel electrode; and the gray-level-voltage output circuit includes;

a first group of holding circuits configured to hold n-bits ($n \geq 2$) data of the display data corresponding to a video signal supplied to the first pixel electrode;

a second group of holding circuits configured to hold the next n-bits data of the display data corresponding to a video signal supplied to the second pixel electrode; and a gray-level voltage generating circuit configured to generate gray-level voltage according to the data held in the first holding circuit during a first period and generate gray-level voltage according to the data held in the second group of holding circuits during a second period, wherein the first group of holding circuits and the second group of holding circuits are arranged to extend along the direction of extension of the video signal line, the first group of holding circuits includes a first holding circuit and a second holding circuit, the second group of holding circuits includes a third holding circuit and a fourth holding circuit, a first common bit data line electrically connects with the first holding circuit and the third holding circuit, a second common bit data line electrically connects with the second holding circuit and the fourth holding circuit, wherein an area ratio of the first pixel electrode to the second pixel electrode is based on a number of gray levels that the gray-level voltage generating circuit is able to generate, the first common bit data line electrically connects with the gray level voltage generating circuit, and the second common bit data line electrically connects with the gray level voltage generating circuit.

5. The display device according to claim 4, wherein the second pixel electrode has an area substantially four times as large as that of the first pixel electrode.

6. The display device according to claim 4, wherein the first holding circuit includes two inverter circuits connected in series.

7. A display device comprising:

a first substrate and a second substrate;

a plurality of pixel sections provided in a matrix form on the first substrate, the pixel sections each having a first pixel electrode and a second pixel electrode having a light transmitting area n times as large as that of the first pixel electrode;

a video signal line for supplying a video signal to the pixel sections; and a gray-level-voltage output circuit configured to output a video signal to the video signal line according to a display data; wherein the gray-level-voltage output circuit is configured to supply an n-levels-of-gray scale voltage to the first pixel electrode and an n-levels-of-gray scale voltage to the second pixel electrode, and the gray-level-voltage output circuit includes;

a first group of holding circuits configured to hold n-bits ($n \geq 2$) data of the display data corresponding to a video signal supplied to the first pixel electrode;

a second group of holding circuits configured to hold the next n-bits data of the display data corresponding to a video signal supplied to the second pixel electrode, wherein the first group of holding circuits and the second group of holding circuits are arranged to extend along the direction of extension of the video signal line, the first group of holding circuits includes a first holding circuit and a second holding circuit, the second group of holding circuits includes a third holding circuit and a fourth holding circuit, a first common bit data line electrically connects with the first holding circuit and the third holding circuit, a second common bit data line electrically connects with the second holding circuit and the fourth holding circuit, wherein an area ratio of the first pixel electrode to the second pixel electrode is based on the number of the n-levels of gray scale voltages that the gray-level-voltage output circuit is able to output, the first common bit data line electrically connects with the gray level voltage generating circuit; and, the second common bit data line electrically connects with the gray level voltage generating circuit.

8. The display device according to claim 7, wherein the second pixel electrode has a light transmitting area substantially four times as large as that of the first pixel electrode.

9. The display device according to claim 7, wherein the gray-level-voltage output circuit outputs a 4-levels-of-gray scale voltage.

10. The display device according to claim 7, wherein the gray-level-voltage output circuit receives 2-bit data and outputs a 4-levels-of-gray scale voltage.

11. The display device according to claim 1, wherein the gray-level-voltage generating circuit further comprises a gray-level-voltage selecting circuit coupled the first and second common bit data line.

12. The display device according to claim 4, wherein the gray-level-voltage generating circuit further comprises a gray-level-voltage selecting circuit coupled to the first and second common bit data line.

13. The display device according to claim 7, wherein the gray-level-voltage generating circuit further includes a gray-level-voltage selecting circuit coupled to the first and second common bit data line.

* * * * *